United States Patent [19]

Freis et al.

[11] Patent Number: 4,810,328

[45] Date of Patent: Mar. 7, 1989

[54] METHOD OF BROWN STOCK WASHING

[75] Inventors: Richard E. Freis, Bloomington; James E. Maloney, Eagan; Thomas R. Oakes, Stillwater, all of Minn.

[73] Assignee: Diamond Shamrock Chemicals Company, Painesville, Ohio

[21] Appl. No.: 117,449

[22] Filed: Nov. 4, 1987

Related U.S. Application Data

[63] Continuation of Ser. No. 833,653, Feb. 21, 1986, abandoned, which is a continuation of Ser. No. 652,311, Sep. 19, 1984, abandoned, which is a continuation-in-part of Ser. No. 630,540, Jul. 13, 1984, abandoned.

[51] Int. Cl.[4] ..... D21C 9/02

[52] U.S. Cl. ..... 162/60; 162/72; 162/76; 162/77

[58] Field of Search ..... 162/60, 72, 76, 77, 162/158; 210/701

[56] References Cited

U.S. PATENT DOCUMENTS

| | | | |
|---|---|---|---|
| 2,144,756 | 1/1939 | Fritz | 162/DIG. 4 |
| 3,021,372 | 2/1962 | Dupre et al. | 260/613 |
| 3,444,242 | 5/1969 | Rue et al. | 260/611 |
| 3,625,909 | 12/1971 | Berg et al. | 252/153 |
| 3,822,178 | 7/1974 | von Koeppen et al. | 162/5 |
| 4,162,186 | 7/1979 | Wood et al. | 162/5 |
| 4,184,912 | 1/1980 | Payton | 162/76 |
| 4,297,164 | 10/1981 | Lee | 162/60 |
| 4,347,099 | 8/1982 | De Ceuster | 162/5 |
| 4,445,971 | 5/1984 | Lappi et al. | 162/158 |
| 4,517,098 | 5/1985 | Hann et al. | 210/701 |

FOREIGN PATENT DOCUMENTS

| | | |
|---|---|---|
| 729071 | 3/1966 | Canada . |
| 197607 | 7/1976 | Japan . |

OTHER PUBLICATIONS

G. G. Hawley, "The Condensed Chemical Dictionary", Van Nostrand Reinhold Company, New York (1974) at p. 858.

*Primary Examiner*—Peter Chin

*Attorney, Agent, or Firm*—Neal T. Levin; Ernest G. Szoke; Wayne C. Jaeschke

[57] ABSTRACT

An improved method of brown stock washing is disclosed. A nonionic surfactant in combination with a polyelectrolyte dispersant, and preferably a solvent, are utilized in the washing step in the pulping of virgin cellulosic fiber. The methods of the invention provide for the enhanced removal and recovery of cooking chemicals and organics from the pulp.

29 Claims, No Drawings

METHOD OF BROWN STOCK WASHING

This is a continuation of application Ser. No. 833,653 filed Feb 21, 1986 abandoned which is a continuation of Ser. No. 652,311 filed 9-19-84 abandoned which is a continuation-in-part of Ser. No. 630,540 filed 7-13-84 abandoned.

FIELD OF THE INVENTION

This invention relates to a method of removing and recovering spent or excess cooking chemicals and pitch from virgin or primary cellulosic fiber. More particularly, the invention relates to an improved method of brown stock washing to enhance the recovery of spent cooking chemical residues and excess cooking chemicals, and remove non-cellulosic materials such as lignin, fatty acid soaps, and resin acids.

BACKGROUND OF THE INVENTION

Virgin cellulosic fiber typically derived from logs of hardwood or softwood, undergoes lengthy processing before it is suitable for use in papermaking. In a typical pulping process, briefly, logs are reduced to wood chips, which are fed into a digester. "Liquor", an aqueous solution obtained from the later described wash step and containing dissolved and residual cooking chemicals, spent cooking chemical residue and cellulosic contaminants, and "white liquor", another by-product of the pulping process known in the art, are fed into the digester, primarily for dilution. Cooking chemicals are also added a required. The cooking chemicals are described hereinafter.

The contents of the digester are brought to a relatively high temperature and pressure, for example about 350° F. at a pressure of about 110 pounds per square inch. The wood chips are "cooked" in the digester under these conditions to reduce the wood chips to pulp. Typically, under these conditions, the wood chips are cooked from about 1 to 5 hours. The cooking can be carried out in batch or continuous digesters.

The cooked wood chips or pulp in the aqueous medium after digestion is referred to as "brown stock". The brown stock consists generally of two phases, the pulp, and the liquor or liquid phase of the digester contents. However, typically after digesting, oversized chips, insufficiently cooked chips, or knots remain. These components are generally removed from the brown stock by knotters which typically consist of coarse screens.

Before further processing of the pulp, it is generally considered necessary to separate the pulp from the liquor. It is also desirable to clean the pulp, removing and to the greatest extent possible, recovering spent or excess cooking chemicals, and removing and recovering pitch contaminants.

After digestion, and following removal of oversized chips and the like, the brown stock is transferred to a washer for a washing step. Typically, the washing process involves a series of washers which separate the pulp from the liquor, and progressively clean the pulp by removal of cooking chemicals, cooking chemical residues, and non-cellulosic contaminants.

Several methods may be used to perform the washing step. In the past, the brown stock was filtered in a false bottom tank or diffuser into which the digester was discharged. The liquor was drained through the false bottom, and the pulp was washed by gravity displacement of the liquor with wash water. Other types of washers such as a pressure washer are also known in the art.

Currently, the rotary vacuum drum or cylinder or vacuum washer is more typically used. As is known to those familiar with the art, the vacuum washer is generally a wire cylinder or drum that rotates in a vat containing the brown stock (i.e. the pulp and liquor mixture). The lower section of the drum is immersed in the brown stock. Vacuum is applied inside the drum as it rotates through the brown stock. The liquor drains through the surface of the wire drum into the interior, leaving a layer of pulp on the outside face of the drum. The layer of pulp is held in place by the vacuum force inside the drum, from where it is conducted away.

The layer of pulp continues to build, forming a mat or sheet, as the submerged portion of the drum rotates through the brown stock in the vat. Liquor continues to drain from the pulp or fiber mat as a result of the differential pressure between the external atmosphere and the vacuum within the cylinder.

Washing action is generally provided by showers located over the pulp sheet. Water is sprayed onto the pulp sheet to displace the liquor from the sheet on the drum as the drum continues to rotate. The vacuum force draws the water into the sheet, where it displaces the liquor. The liquor drains out the other side of the sheet into the inside of the cylinder, where it drains away to a filtrate storage tank for reuse, for example as wash water for a more contaminated sheet which has formed on another of the washers in the series.

Finally, the pulp sheet is removed from the face of the wire by a doctor blade.

The surface of the sheet where the wash water is applied becomes cleaner than the pulp adjacent to the cylinder at the bottom of the sheet, since the wash water becomes more concentrated in liquor as it passes through the sheet. Consequently, where a series of washers is utilized, the pulp sheet obtained from the first vacuum washer is generally repulped to provide a more uniformly clean pulp before traveling over the second vacuum washer. This repulping step is generally repeated between each vacuum washer in the sequence.

In the repulping step, the pulp fibers are agitated at a low consistency (i.e. the pulp is very dilute) in order to facilitate scrubbing. The low consistency also aids in a achieving a lowered concentration of dissolved solids, prior to collection of the pulp on the next washer in the series. Low consistency promotes diffusion of the contaminated liquor from the pulp in the repulping step.

In a sequence of washers, the pulp medium and the wash water are generally arranged to flow countercurrent to each other. Fresh water is typically used to wash the pulp sheet on the last stage washer. The filtrate that was pulled through pulp sheet on each washer is used to wash the pulp on the preceeding washer. This aids in minimizing dilution of the liquor which is separated from the pulp, and from which cooking chemicals or cooking chemical residues are to be recovered, as described hereinafter.

The cooking chemicals used in pulping mills are known in the art. Briefly, the cooking system is generally either kraft or sulfite. Other cooking systems are also known in the art.

The kraft system generally involves the use of sodium hydroxide and sodium sulfide in the digester to aid in decomposition of the wood fibers to produce pulp. The sodium may be added as sodium sulfate, sodium carbonate, or similar sodium compounds. The sulfite system typically involves the use of $SO_2$ and magnesium, calcium, sodium or ammonia. The kraft mill generates "black liquor", while the counterpart in the sulfite mills is referred to as "red liquor". For the purpose of this description, the term "liquor" refers to both "red" and "black" liquor, and the aqueous phase of the pulp mixture resulting from other pulp processing methods such as those described below.

Some pulping mills form pulp from wood products without the use of cooking chemicals. Several such pulping processes are known, including mechanical processes such as the groundwood process, use of a refiner to create refiner mechanical pulp, or use of heat to create thermomechanical pulp. Most such processes rely on heat and mechanical action to break down the wood fibers. Other processes, such as the NSSC process, rely on both chemical and mechanical action. While these mechanical, thermomechanical, or semi-chemical processes typically do not involve washing steps, where washing steps are used the methods of this invention can aid in cleaning the pulp and recovering organic contaminants.

Before washing, the brown stock will contain many impurities from the pulping process, including excess cooking chemicals and spent cooking chemicals (where chemicals are used in the pulping), and also a variety of organic contaminants such as resin acids, fatty acid soaps and the like originating in wood. The contaminants occlude to the pulp fibers, and are also present in the aqueous phase of the brown stock. It has been found that in general, the contaminants of black liquor and the corresponding pulp are principally alkali lignin, hydroxy acids and lactones, and sodium. Generally, black liquor is also contaminated with acetic acid, formic acid, sulfur, extractives, and methanol. Red liquor (obtained through the sulfite process) and the corresponding pulp has been found to be contaminated with lignosulfonate, monosaccharides (mannose, xylose, galactose, glucose and arabinose), poly and oligosaccharides, calcium, aldonic acids, sugar-sulfonates, extractives, acetic acid, methanol, and glucuronic acid. These materials are substantially different from those encountered in deinking or dewaxing repulping proceseses, where the contaminants are generally inorganic substances and very different organic compounds.

It is highly desirable to recover or reclaim the cooking chemical residues for reuse, to reduce the amount of chemicals which must be purchased by the mill. Those residues which remain in the pulp after the pulping process are generally not recovered, and contaminate the pulp products. Those residues which are carried by the liquor tend to be recoverable. Therefore, it is advantageous to decrease the amount of chemicals carried by or occluded to the pulp and increase the amount carried by the liquor. In particular, it is desirable to effect a transfer of chemicals from the pulp to the liquor.

Such a transfer can be achieved to a great extent by the washing of the pulp. However, for production level washing to obtain large quantities of pulp at a high quality level or level of purity, vast quantities of wash water are required. The wash water dilutes the liquor and chemicals washed from the pulp. Since recovery of the chemicals involves distillation, or evaporation of the aqueous component, it can be significantly more expensive to recover chemicals from a more dilute solution, off-setting the cost benefits to be achieved by recovery. Thus, a substantial need exists for a method of washing virgin pulp which will sufficiently remove excess and spent cooking chemicals from the pulp and otherwise clean the pulp without causing excessive dilution.

In addition to the problems of recovering inorganic cooking chemical residues, another similar set of second problems encountered in pulping virgin pulp results from the presence of lignin and other organic substances such as resin acids, fatty acid soaps, etc. in wood chips. It is desirable to recover these substances because they are economically or commercially valuable, for example, when recovered as tall oils. In addition, pulp which retains a high level of such materials may require the use of more chemicals in the bleaching step, thus rendering the bleaching step more costly. A need exists for a method of washing virgin pulp which will result in greater recovery of organic substances and lighter colored pulp while minimizing the amount of dilution or wash water required to obtain these results.

BRIEF DESCRIPTION OF THE INVENTION

I have found that the addition of a nonionic surfactant, a dispersant, and preferably a solvent to the wash water or the brown stock itself will result in unexpectedly improved washing of virgin pulp. By the method of this invention, a given quantity of wash water will result in surprisingly increased removal of spent or excess cooking chemical compounds and organic contaminants, thus minimizing dilution in the washing process while providing cleaner, and generally lighter colored, pulp and facilitating economical recovery of the cooking chemical residues and organics.

DETAILED DESCRIPTION OF THE INVENTION

The present invention involves use in the wash process of a nonionic surface active agent or surfactant in combination with a dispersant, and preferably a solvent. The surfactant comprises an oxyethylene glycol chain, wherein one terminal hydroxyl of the chain has been replaced with an ether group selected from the group consisting of an aliphatic ether group and an alkylaromatic ether group, and the other terminal hydroxyl of the chain has been replaced with an ether group selected from the group consisting of a polyoxypropylene group and a benzyl ether group. A typical formula for preferred surfactants of this invention would be as follows:

$$R\,(Ar)_a\,(OC_2H_4)_n\,(OC_3H_6)_m\,Y$$

wherein a is zero or 1,

Ar represents an aromatic residue, preferably monocyclic,

R represents an aliphatic group, n has a value from about 3 to about 50, m has a value from about zero to about 50, and Y is selected from the group consisting of hydroxy and benzyl ether and is benzyl ether when m equals 0.

The R group is typically saturated and contains at least 6 carbons. When a equals zero, R contains from 6 to 24 carbons; when a equals 1, R normally contains no more than 18 carbon atoms. In short, the $R(Ar)_a$ group contains at least 6 aliphatic carbon atoms and up to a total of 24 carbon atoms.

The foregoing structural formula can be considered to encompass two major classes of surfactants, i.e. (a) alkylene oxide adducts of alkylphenols, and (b) alkylene oxide adducts of higher (greater than $C_5$) aliphatic alcohols or acids. Acids which can be utilized in the formation of the surfactant include lauric, myristic, oleaic, linolenic, palmitic and stearic. Where the adduct of an aliphatic acid is used, typically R will contain from 6 to 24 carbon atoms, and may contain some unsaturation.

The surfactants contemplated for use in the invention are generally low foaming surfactants which do not significantly contribute to foam problems within the system.

These surfactants are described in detail in commonly assigned U.S. patent application Ser. No. 093,744 filed Nov. 13, 1979 on behalf of of Richard E. Freis, James E. Maloney and Thomas R. Oakes, entitled "Methods of Deinking Secondary Fibers", the entire disclosure of which is incorporated by reference herein. A continuation of U.S. Ser. No. 093,744 was filed on Jan. 17, 1983, and has been assigned U.S. Ser. No. 458,432, now U.S. Pat. No. 4,518,459, the disclosure of which is incorporated by reference herein.

The present invention also involves the use of polyelectrolyte dispersants. A "polyelectrolyte dispersant" as the term is intended herein means any homo, co, ter, etc., polymer of the structure:

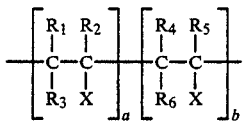

wherein $R_1$, $R_2$, $R_4$ and $R_5$ are independent and can be hydrogen, $C_1$–$C_4$ lower alkyl, alkylcarboxy (e.g., $—CH_2COOH$) or mixtures thereof; $R_3$ and $R_6$ can be hydrogen, carboxy, alkylcarboxy, or mixtures thereof, and X can be carboxy (including salts or derivatives thereof, e.g., amide), acetyl, or hydrocarbon moieities commonly attached to free radical polymerizable monomers (e.g., $—C_6H_5$ in styrene); a+b having a value in the range of 15 to about 1,000.

Examples of materials within the scope of the above formula include polymaleic acid, polyacrylic acid, polymethacrylic acid, polyacrylic acid/itaconic acid copolymers, polyacrylic acid/hydrolyzed maleic acid copolymers, polymaleic acid/itaconic acid copolymers, hydrolyzed polymaleic acid/vinyl acetate copolymers, polyacrylic acid/acrylamide copolymers, polyacrylic acid/methacrylic acid copolymers, styrene/maleic acid copolymers, sulfonated styrene/maleic acid copolymers, polymaleic acid/methacrylic acid copolymers, maleic acid telomers, maleic/alkyl sulfonic copolymers.

A particularly preferred class of water soluble polyelectrolytes for use in the practices of the present invention is the polyacrylate compounds. The polyacrylate compounds comprise polymers and copolymers of the structure:

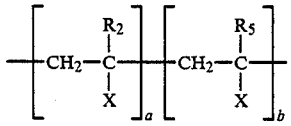

and their derivatives, wherein $R_2$, $R_5$, X, a and b are defined as above.

In a most preferred practice of the present invention, X is —COOZ, wherein Z is H, or a monovalent cation, e.g. $Na^+$, $K^+$, or $NH_4^+$. Thus, typical of the preferred polyelectrolytes of the present invention are polyacrylic acid, polymethacrylic acid and copolymers of acrylic acid/methacrylic acid (e.g., AQUATREAT available from ALCO Chemical).

The polyelectrolytes of this invention must be water soluble. Generally speaking, to be water soluble, the polymer must contain sufficient polar groups (e.g., COOH) for the molecule to interact with the polar water molecules. This means that in copolymers, terpolymers, tetramers, etc., with unsaturated monomers which are predominantly or entirely hydrocarbon (e.g., styrene) there must be sufficient polar functional groups for the polymer to dissolve in room temperature or below water. Generally, at least about 10 mole percent of the monomers comprising the polymer must contain polar functionality (e.g.,

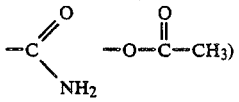

to provide the required water solubility.

The low molecular weight polyelectrolytes of present invention generally have molecular weights of less than about 50,000 with preferred molecular weights in the range of about 500 to 25,000, most preferably of 750 to 5,000. Thus, the sum of a+b above, generally falls in range of 5 to 1,000, preferably 10 to 500 and most preferably 12 to 450. One skilled in the art will recognize that the materials within the above molecular weight ranges are generally of lower molecular weight than polymers generally referred to in the art as flocculants which may have molecular weights in the range of several million or more. Flocculants perform function of agglomerating suspended particles opposite the desired function of dispersion described herein. Thus, these high molecular weight materials operate in a manner effectively opposite that of the materials described herein. The lower molecular weight materials of the present invention are generally referred to in the art as "dispersants".

The improvement of the present invention optionally contemplates the use of various well-known water soluble solvents or cosolvents, along with the dispersants and surfactants. The solvents unexpectedly provide increased removal of contaminants of the pulp, when used in the context of this invention and use of such solvents is recommended. The solvents can be ethoxylated solvents such as the glycol ethers available under the trademarks Cellosolve and Carbitol. Preferred examples of solvents for use in this invention include tetrahydrofuran, tetrahydrofurfuryl alcohol, and ethoxylated and propoxylated derivatives thereof. It has been found that tetrahydrofurfuryl alcohol is particularly beneficial in the context of the invention, and it is theorized that this component contributes to the high recovery of spent cooking chemicals and the improved level of pulp purity obtained by the method of this invention.

Functionally speaking, the nonionic surfactant, dispersant, and solvent additives of the invention should be utilized in sufficient amounts or ratios to achieve increased recovery of cooking chemicals and soluble organics, and increased pulp purity after washing with a given volume of water. I have found that the components produce the best results at a surfactant: dispersant ratio from about 0.5:1 to 2:1. Where the solvent is used, I have found the more effective ratios of surfactant: solvent to be from about 0.5:1 to 1:1.

As used in brown stock washing, I have found the desired concentration of the nonionic surfactants in the context of this invention to be generally in the range of about 0.01 to 30 lbs/ton oven dried pulp, with concentrations in the range of about 0.15 to 5 lbs/ton being preferred. The concentrations of the polyelectrolyte dispersants should fall generally in the range of about 0.01 to 30 lbs/ton, or preferrably 0.1 to 4 lbs/ton. With respect to the solvent, the concentration should fall in the range of about 0–25 lbs/ton, or more preferably, 0.1 to 4 lbs/ton. As known in the art, "pounds per ton" refers to the weight of the additives in pounds, as compared to the weight in tons of oven dried pulp which is washed.

The additives can be supplied to various locations within the pulping system, such as any of the shower heads for the washers, the washer vats, the filtrate storage tank from where filtrate is recirculated through the washers, the digester, the deknotter, the repulper, or the like. I have found that the additives are distributed throughout the washing system particularly well when they are added to the shower head of an intermediate washer in a series of washers, such as the second in a series of three.

The additives can be added individually, or can be premixed and added as a mixture. Preferably, for reasons of convenience and greater effectiveness, the additives are premixed. In a preferred embodiment, a mixture of from 10 to 60% nonionic surfactant, 10 to 60% polyelectrolyte dispersant, and 0 to 50% solvent to total 100% is utilized at a level of from about 0.1–50.0 pounds per ton of pulp (oven dried) to be washed. More preferably, the mixture will comprise from 30 to 50% nonionic surfactant, from 20 to 40% polyelectrolyte dispersant, and from 20 to 40% solvent to total 100%. With respect to the concentration, more preferably, to achieve a suitable level of effectiveness at greater economy, the concentration will range from about 0.5–5.0 pounds per ton, with the mixture being added in the shower head of an intermediate washer in a series of washers.

The temperature of the wash water can range from about 100° to 212° F., preferably in the range of about 140° to 180° F.

While not wishing to be limited to any theory, I theorize the surprisingly beneficial results achieved by method of this invention may result from the prevention of channeling within the mat, such that more of the wash water actually penetrates the mat and more efficiently displaces the liquor and impurities such as spent cooking chemicals and organic substances.

The invention will be further understood by reference to following examples which include the preferred embodiment.

EXAMPLE I

Example I was performed at a typical sulfite pulping mill having three rotary cylinder vacuum washers in sequence. Pre-trial, trial and post-trial production runs were monitored. The "pre-trial" data are taken from the mill during standard production, over a period of twenty-one days. The trial occurred over a twenty-seven day period wherein the invention was utilized at the mill under otherwise standard conditions. Post-trial data were taken during approximately twenty-one days following the end of the trial, again during standard production without use of the invention. The pre-trial and post-trial data are in the nature of a control, for comparison with the data obtained from use of the method of the invention.

The trial procedure was as follows:

| Day | Lbs./ton Additive |
|---|---|
| 1 | 0.5 |
| 2 | 1.0 |
| 3 | 1.0 |
| 4 | 1.5 |
| 5 | 1.5 |
| 6 | 1.5 |
| 7 | 1.5 |
| 8 | 1.5 |
| 9 | 1.5 |
| 10 | 1.0 |
| 11 | 1.0 |
| 12 | 1.5 |
| 13 | 1.5 |
| 14 | 1.5 |
| 15 | 1.5 |
| 16 | 1.5 |
| 17 | 1.0 |
| 18 | 1.0 |
| 19 | 1.0 |
| 20 | 1.0 |
| 21 | 1.0 |
| 22 | 2.0 |
| 23 | 2.0 |
| 24 | 2.0 |
| 25 | 0 |
| 26 | 2.0 |
| 27 | 2.0 |

The additive used during the trial was in all cases provided to the #2 shower. It comprised a mixture of 40% by weight of a modified alcohol ethoxylate with a specific gravity of 0.97, and an activity of 100%, 30 wt-% of a low molecular weight polyacrylic acid in the form of a 48 to 50% aqueous solution, having a pH at 100% of 1.5–2.0, and about 30 wt-% tetrahydrofurfuryl alcohol having a molecular weight of about 102, a specific gravity at 20/20° C. of about 1.0543. The temperature of the #2 shower solution ranged from 120–160° F. during the trial.

Test results were as follows:

TABLE I

| | Pre-Trial | Trial | Post-Trial |
|---|---|---|---|
| Daily Production (tons per day) | 385<br>N = 23<br>S = 33.2 | 399<br>N = 27<br>S = 47.9 | 376<br>N = 21<br>S = 37.93 |
| Cooks (No./day) | 6.1 | 6.8 | 7.3 |
| Knotter Flow (gallons per minute) | 2504<br>N = 10<br>S = 199<br>(98%) | 2750<br>N = 26<br>S = 281 | 2568<br>N = 21<br>S = 226<br>(98%) |
| Knotter TDS (%) | 8.81<br>N = 6<br>S = 0.43<br>(97%) | 9.86<br>N = 26<br>S = 1.10 | 8.71<br>N = 21<br>S = 0.45<br>(99%) |
| #1 Washer Filtrate TDS (%) | 8.38<br>N = 6<br>S = 0.39<br>(99%) | 9.89<br>N = 26<br>S = 1.07 | 8.63<br>N = 21<br>S = 0.46<br>(99%) |
| 3 Washer Mat TDS (%) | 0.475<br>N = 6<br>S = 0.142<br>(82%) | 0.399<br>N = 26<br>S = 0.158 | 0.480<br>N = 21<br>S = 0.230<br>(82%) |
| #3 Washer Shower Flow (gallons per minute) | 696<br>N = 23<br>S = 8<br>(99%) | 755<br>N = 26<br>S = 18 | 736<br>N = 21<br>S = 39<br>(99%) |
| Red Liquor | 9.97% | 10.27 | 9.86 |

TABLE I-continued

| | Pre-Trial | Trial | Post-Trial |
|---|---|---|---|
| Solids (%) | N = 23<br>S = 0.48<br>(99%) | N = 27<br>S = 0.52 | N = 21<br>S = 0.37<br>(99%) |
| Surge Tank Solids Loss (lb./ton) | 75.74<br>N = 23<br>S = 17.08<br>(82%) | 74.88<br>N = 26<br>S = 11.34 | 71.51<br>N = 21<br>S = 8.85<br>(75%) |
| Overall Efficiency (%) | 95.35%<br>N = 6<br>S = 1.22<br>(85%) | 96.37%<br>N = 26<br>S = 1.59 | 94.44%<br>N = 21<br>S = 3.24<br>(99%) |
| #3 Washer Mat Extractables % | 1.197<br>N = 3<br>S = 0.17<br>(92%) | 1.014<br>N = 13<br>S = 0.14 | 1.140<br>N = 15<br>S = 0.16<br>(90%) |

The knotter TDS refers to the total dissolved solids in the liquid phase from the knotter, before washing of the pulp.

The #1 washer filtrate TDS refers to the total dissolved solids of the filtrate recovered from the first rotary cylinder vacuum washer in the series of three. A higher value indicates that a greater number of impurities have been washed from the pulp.

Number 3 washer mat TDS refers to the total dissolved solids of the mat itself which forms on washer #3. This is calculated by squeezing liquid from the mat, and testing that liquid for total dissolved solids. It is understood in the art that the composition of the liquid squeezings corresponds to the composition of the mat itself. A lower number indicates a more pure mat and is preferred.

Number 3 washer shower flow refers to the gallons per minute of wash water flowing from the head of shower number 3.

Red liquor solids refers to the weight percent of solids compared to the total weight of the red liquor. This value indicates the presence of impurities such as cooking chemicals, lignin and the like which the pulp contains after digestion and which are removed during washing. A higher number indicates that more impurities have been removed from the pulp and will be recoverable.

Surge tank solids loss reflects the solids, whether cooking chemicals, lignin and the like, which are lost to recovery, that is, which have been carried over with the pulp and are therefore unrecovered. A lower value is preferred.

Overall efficiency is expressed as a percentage. A higher percentage for overall efficiency indicates greater washing efficiency and is more desirable. It is calculated by the following formula:

$$\text{Efficiency} = \frac{(TDS\ \#1\ vat) - (TDS\ \#3\ mat)}{(TDS\ \#1\ vat) - (TDS\ \#3\ \text{shower})} \times 100$$

In the formula, "TDS" refers to "total dissolved solids". The TDS #1 vat refers to the total dissolved solids of the brown stock in the vat of the first in the series of washers. TDS #3 mat is a value obtained by analysis of the squeezings of the mat formed on the #3 washer. TDS #3 shower reflects the total dissolved solids of the wash water sprayed through the #3 shower head.

Number 3 washer mat extractables is expressed as the weight percent of impurities as compared to the total weight of the mat. This test was performed following the TAPPI method but using a mixture of toluene and alcohol for the extraction process, rather than benzene and alcohol. A lower number indicates fewer organic soluble impurities in the pulp or mat.

With respect to the data, N indicates the number of samples which were tested. The values obtained were then analyzed via Student T test to provide the value given in Table I. S represents the standard of deviation among the values obtained. The percentage given in parentheses indicates the confidence limits of the value.

Discussion of Results

Regression equations were developed using pre-trial and trial data with addition of the additive mixture as described in the example at a level of 1.5 lb/ton. All work was done through multiple linear regression. Terms included in the equations are significant at a level of ($P \leqq 0.05$). The regression equations are as follows:

Red Liquor Solids = 9.813 + 1.352 × # *Mat TDS* + 1.190 × lb./ton additive mixture used in Example + 0.077 × #1 *Vat TDS* − 0.167 × Cooks (No./day). $R^2 = 0.8102$.

Surge Tank Solids Loss = 117.12 + (2.68 × Cooks (No./day)) + (0.022 × Knotter flow) − (1.78 × Efficiency) + (0.120 × daily production). $R^2 = 0.5535$.

#3 *Mat TDS* = 6.552 + (0.030 × Knotter *TDS*) − (0.066 × Efficiency) − (0.041 × lb./ton additive mixture used in Example). $R^2 = 0.6658$.

Red Liquor solids increased during the trial and decreased the post-trial period. The regression equation confirms a positive effect on red liquor solids equivalent to 0.19% per 1 pound/ton of the additive mixture, or approximately 0.30% at the average trial feed rate of 1.5 pounds/ton.

Results of the #1 washer filtrate total dissolved solids values indicate a significant increase, showing markedly better washing results with use of the additive mixture. Knotter total dissolved solids also increased during the trial.

The total dissolved solids in the #3 washer mat decreased 17% during the trial, compared to the pre-trial and post-trial average. This value indicates surprisingly effective solids removal. The regression equation indicates that the effect of the additive mixture on #3 washer mat total dissolved solids is a decrease of 0.0615% when the additive mixture is used at 1.5 pound/ton.

Overall efficiency for the three washers was found to be significantly increased during the trial. The post trial value is considered to be more reliable than the pre-trial value due to the small sample size for the pre-trial data. Efficiency was calculated from oven dried total dissolved solids.

Number 3 washer mat extractables showed a 12% decrease during the trial versus post-trial period, an unexpectedly high decrease particularly in view of the high production rates during the trial.

EXAMPLE II

Example II was performed as was Example I, in the same sulfite mill using the same standard procedures. The same additive was also used.

The first pre-trial lasted 8 consecutive days, followed later by an addtional 12 day pre-trial period, where data were collected regarding the standard mill operation. The trial period immediately followed the 12 day pre-trial, and lasted 5 days, while the post-trial period immediately followed the trial and lasted 3 days.

The trail procedure for Example II was as follows:

| Day | Time | Action |
|---|---|---|
| 1 | 10:30 a.m. | Sample run |
| | 10:45 a.m. | Additive in at 0.5 lb./ton to #2 shower |
| | 1:15 p.m. | Sample run |
| | 2:05 p.m. | Additive increased to 1.0 lb./ton |
| | 3:00 p.m. | Sample run |
| 2 | 8:00 a.m. | Sample run |
| | 10:00 a.m. | Sample run |
| | 10:15 a.m. | Additive increased to 1.5 lb./ton |
| | 1:00 p.m. | Sample run |
| 3 | 8:30 a.m. | Sample run |
| | 10:30 a.m. | Sample run |
| | 10:35 a.m. | Additive increased to 2.0 lb./ton |
| | 12:30 p.m. | Sample run |
| 4 | 8:30 a.m. | Sample run |
| | 10:30 a.m. | Sample run |
| | 12:30 p.m. | Sample run |
| 5 | 8:30 a.m. | Sample run |
| | 9:00 a.m. | Additive off |

Squeezings were taken from mat #3 at various times during trial and post trial as indicated at "sample run", and were in some cases analyzed for water soluble inorganics using the TAPPI testing procedure, except that toluene and alcohol were used instead of benzene and alcohol. The results of the #3 mat squeezings analysis, in parts per million, is as follows:

| | #3 Mat Squeezings Trial | | | Post-Trial |
|---|---|---|---|---|
| Day: Time: | Day 1 Afternoon | Day 2 Morning | Day 4 Morning | Day 5 of Post Trial |
| Chloride | 9.3 | 5.3 | 4.4 | 11.6 |
| Sulfate | 125 | 438 | 398 | 1350 |
| Aluminum | 4 | 4 | 4 | 1.0 |
| Barium | 2 | 2 | 2 | 0.7 |
| Iron | 3.6 | 7.0 | 3.0 | 6.0 |
| Silica as $SiO_2$ | 17 | 17 | 17 | 16 |
| Calcium | 10 | 15 | 20 | 93 |
| Magnesium | 83 | 200 | 240 | 1200 |
| Sulfite by iodine titration | 40 | 10 | 40 | 620 |

The average of the #3 mat dissolved solids, expressed as a percentage by weight solids/weight of the squeezings as a whole, was as follows:

| First Pre-trial | Average of Second Pre-Trial and Post Trial | Trial |
|---|---|---|
| 0.48 | 0.49 | 0.42 |

Results

Dissolved solids in the #3 mat were decreased from an average of 0.49% to 0.42% during the trial, indicating a reduction of soluble inorganics and organics. Water analysis of the #3 mat confirmed the significant reduction of inorganics during the trial. These results show a trend indicating an unexpectedly high reduction in inorganic and organic solids carried in the #3 mat during the use of the additive mixture in the #2 shower.

The foregoing description and Examples are exemplary of the invention. However, since persons skilled in the art can devise various embodiments without departing from the spirit and scope of the invention, the invention is embodied in the claims hereinafter appended.

I claim:

1. An improved method of removing spent or excess cooking chemical compounds or organic contaminants from chemically or mechanically prepared virgin pulp, which comprises:

(a) forming a fiber mat of chemically or mechanically prepared virigin pulp; and (b) forcing a solution consisting essentially of water, substituted oxyethylene glucol non-ionic surfactant, water-soluble low molecular weight polyeleectrolyte dispersant and water soluble solvent into and through the fiber mat, there being from aobut 10% by weight to aobut 60% by weight non-ionic surfactant, from aobut 10% by weight to about 60% by weight low molecular weight polyelectrolyte dispersant and from about 20% by weight to about 50% by weight of water-soluble solvent.

2. The method of claim 1 wherein forcing the aqueous solution into and through the fiber mat comprises applying the aqueous solution to the mat and drawing the solution into and through the mat with a vacuum force.

3. The method of claim 2 wherein applying the aqueous solution to the mat comprises spraying the aqueous solution onto a surface of the mat.

4. The method of claim 3 wherein the fiber mat is formed using a rotary drum vacuum washer.

5. The method of claim 3 wherein the temperature of the aqueous solution is from about 100° to 212° F.

6. The method of claim 1 wherein the solvent is at least one of tetrahydrofuran, tetrahydrofurfuryl alcohol and ethoxylated and propoxylated derivatives thereof and ethoxylated solvent.

7. The method of claim 1 wherein the substituted oxyethylene glycol non-ionic surfactant, the water soluble low molecular weight polyelectrolyte dispersant, and the solvent together are provided at a total concentration of from about 0.1 to 50.0 pounds per ton of oven dried pulp, the total concentration being composed of 10 to 60% by weight surfactant, 10 to 60% by weight dispersant, and 20 to 50% by weight solvent.

8. The method of claim 7 wherein the total concentration is from about 0.5 to 5.0 pounds per ton of oven dried pulp.

9. The method of claim 1 wherein the polyelectrolyte dispersant includes a copolymer of maleic acid and vinyl acetate.

10. The method of claim 1 wherein the polyelectrolyte dispersant includes a polyacrylate compound.

11. The method of claim 10 wherein the polyacrylate compound has a molecular weight in the range of 500 to 25,000.

12. The method of claim 1 wherein the polyelectrolyte dispersant is of the structure:

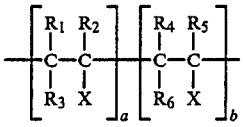

wherein $R_1$, $R_2$, $R_4$ and $R_5$ are independent and are selected from the group consisting of hydrogen, $C_1$–$C_4$ lower alkyl, alkylcarboxy or mixtures thereof, $R_3$ and $R_6$ are independent and selected from the group consisting of hydrogen, carboxy, alkylcarboxy, or mixtures thereof, X is selected from the group consisting of carboxy, salts and derivatives of carboxy, acetyl, hydrocarbon moieties capable of being attached to free radical monomers, COOZ where Z is H, a monovalent metal ion or ammonium, or mixtures thereof; and the total of a+b falls in the range of 15 to 1,000.

13. The method of claim 12 wherein $R_1$, $R_3$, $R_4$ and $R_6$ are hydrogen, $R_2$ and $R_5$ are hydrgen or methyl, and x is carboxy.

14. The method of claim 1 wherein the surfactant comprises an oxyethylene glycol chain, wherein one terminal hydroxyl of the chain has been replaced with an ether group selected from the group consisting of an aliphatic ether group or an alkylaromatic ether group, and the other terminal hydroxyl of the chain has been replaced with an ether group selected from the group consisting of a polyoxypropylene group and a benzyl ether group.

15. The method of claim 4 wherein the surfactant comprises an oxyethylene glycol chain, wherein one terminal hydroxyl of the chain has been replaced with an ether group selected from the group consisting of an aliphatic ether group or an alkylaromatic ether group, and the other temrinal hydroxyl of the chain has been replaced with an ether group selected from the group consisting of a polyoxypropylene group and a benzyl ether group.

16. A method of recovering excess or spent cooking chemical compounds or organic contaminants from an aqueous pulping medium comprising chemically or mechanically prepared virgin pulp and excess or spent chemical compounds or organic conaminants, which comprises:

(a) combining the aqueous pulping medium with an additive mixture consisting esentially of a substituted oxyethylene glycol non-ionic surfactant, a water-soluble low molecular weight polyelectrolyte dispersant and a solvent selected from the group consisting of terahydrofuran, tetrahydrofurfuryl, alcohol and ethoxylated and propoxylated derivatives thereof and ethoxylated solvent, there being from about 10% by weight to about 60% by weight non-ionic surfactant, from about 10% by weight to about 60% by weight low molecular wieght polyelectrolyte dispersant and from about 20% by weight to about 50% by weight of solvent;

(b) substantially separating the chemically or mechanically prepared virgin pulp from the aqueous pulping medium; and (c) after step (b), removing excess or spent cooking chemical compounds or organic contaminants from the aqueous pulping medium.

17. The method of claim 16 wherein in substantially separating the chemically or mechaincally prepared virgin pulp from the aqueous pulping medium, the chemically or mechanically prepared virgin pulp is washed in a washing step.

18. The method of claim 16 wherein the chemically or mechanically prepared virgin pulp is substantially separated from the aqueous pulping medium and washed by a rotary vacuum cylinder washer.

19. The method of claim 16 wherein the substituted oxyethylene glycol non-ionic surfactant, the water soluble low molecular weight polyelectrolyte dispersant, and the solvent together are provided at a total concentration of from about 0.1 to 50.0 pounds per ton of oven dried pulp, the total concentration being composed of 10 to 60% by weight surfactant, 10 to 60% by weight dispersant, and 20 to 50% by weight solvent.

20. The method of claim 19 wherein the total concentration is from about 0.5 to 5.0 pounds per ton of oven dried pulp.

21. The method of claim 16 wherein the polyelectrolyte dispersant includes a copolymer of maleic acid and vinyl acetate.

22. The method of claim 16 wherein the polyelectrolyte dispersant comprises a polyacrylate compound.

23. The method of claim 22 wherein the polyacrylate compound has a molecular weight in the range of 500 to 25,000.

24. The method of claim 16 wherein the polyelectrolyte dispersant is of the structure:

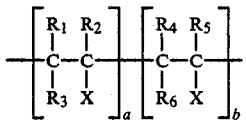

wherein $R_1$, $R_2$, $R_4$ and $R_5$ are independent and are selected from the group consisting of hydrogen, $C_1$–$C_4$ lower alkyl, alkylcarboxy or mixtures thereof, $R_3$ and $R_6$ are independent and selected from the group consisting of hydrogen, carboxy, alkylcarboxy, or mixtures thereof, X is selected from the group consisting of carboxy, salts and derivatives of carboxy, acetyl, hydrocarbon moieties capable of being attached to free radical monomers, COOZ where Z is H, a monovalent metal ion or ammonium, or mixtures thereof; and the total of a+b falls in the range of 15 to 1,000.

25. The method of claim 24 wherein $R_1$, $R_3$, $R_4$ and $R_6$ are hydrogen, $R_2$ and $R_5$ are hydrogen or methyl, and x is carboxy.

26. The method of claim 23 wherein there is present tetrahydrofurfuryl alcohol as solvent.

27. A method for removing spent or excess cooking chemical compound or organic contaminants from chemically or mechaincally prepared virgin pulp, which comprises:

(a) forming a fiber mat of chemically or mechanically prepared virgin pulp; and (b) forcing an aqueous solution comprising non-ionic surfactant of the formula:

$$R(Ar)_a(OC_2H_4)_n(OC_3H_6)_mY$$

wherein Ar is a monocyclic aromatic residue, a is 0 or 1, R is a saturated aliphatic group containing at least 6 carbon atoms, n is 3–50, m is 0–50 and Y is OH, or benzyloxy when m is 0; water-soluble low molecular weight polyelectrolyte dispersant and at least one solvent selected from the group consisting of tetrahydrofuran, tetrahydrofurfuryl alcohol and ethoxylated and propoxylated derivatives thereof and ethoxylated solvent into and through the fiber mat, there being from about 10% by weight to about 60% by weight non-ionic surfactant, from aobut 10% by weight to about 60% by weight low molecular weight polyelecrolyte dispersant and from about 20% by weight to about 50% by weight of solvent.

28. An improved method of removing spent or excess cooking chemical compounds or organic contaminants from chemically or mechanically prepared virgin pulp, which comprises:

(A) forming a fiber mat of chemiclly or mechanically prepared virgin pulp; and (b) forcing solution consisting essentially of water, a substituted oxyethylene glucol non-ionic surfactant, an ethoxylated solvent, and a water-soluble low molecular weight polyelectrolyte dispersant into and through the fiber mat, there being from aobut 10% by weight to about 60% by weight non-ionic surfactant, from about 10% by weight to about 60% by weight low molecular weight polyelectrolyte dispersant and from about 20% by weight to about 50% by weight of solvent.

29. A method of recovering excess or spent cooking chemical compounds or organic contaminants from an aqueous pulping medium comprising chemically or mechanically prepared virgin pulp and excess orspent chemical compounds or organic contaminants, which comprises:

(a) combining the aqueous pulping medium with an additive mixture consisting essentially of from about 10% by weight to about 60% by weight of substituted oxyethylene glycol non-ionic surfactant, from about 10% by weight to about 60% by weight of water-soluble low molecular weight polyelectrolyte dispersant and from about 20% by weight to about 50% by weight of water-soluble solvent;

(b) substantially separating the chemically or mechanically prepared virgin pulp from the aqueous pulping medium; and (c) afer step (b), removing excess or spent cooking chemical compounds or organic contaminants from the aqueous pulping medium.

* * * * *

UNITED STATES PATENT AND TRADEMARK OFFICE

CERTIFICATE OF CORRECTION

PATENT NO. : 4,810,328

DATED : March 7, 1989

INVENTOR(S) : James E. Maloney et al.

It is certified that error appears in the above-identified patent and that said Letters Patent is hereby corrected as shown below:

On the title page item [75] Inventors:

The inventors should read --James E. Maloney, Eagan; Richard E. Fries, Bloomington; Thomas R. Oakes, Stillwater, all of Minn.

In claim 1, at column 12, lines 28 and 29, "aobut" should read --about--.

In claim 13, at column 13, line 22, "hydrgen" should read --hydrogen--.

Signed and Sealed this

Seventh Day of April, 1992

*Attest:*

HARRY F. MANBECK, JR.

*Attesting Officer*

*Commissioner of Patents and Trademarks*